United States Patent [19]

Flores, Jr. et al.

[11] Patent Number: 4,485,543

[45] Date of Patent: Dec. 4, 1984

[54] WALLBOARD POSITIONING APPARATUS

[76] Inventors: Rodolfo Flores, Jr.; Oscar Flores, both of 1911 Windy Peaks Ct., Houston, Tex. 77067

[21] Appl. No.: 451,462

[22] Filed: Mar. 14, 1983

[51] Int. Cl.[3] ..... B25B 27/14

[52] U.S. Cl. ..... 29/281.1; 81/303; 81/418; 269/904

[58] Field of Search ..... 81/418, 425 R, 425 A, 81/303, 304, 305, 306, 307, 308, 309, 310, 311, 312; 269/904; 29/281.1, 281.5, 281.6

[56] References Cited

U.S. PATENT DOCUMENTS 2,641,149 6/1953 Petersen ..... 81/425 R 2,743,873 5/1956 Burke ..... 81/418

3,154,304 10/1964 Crawford ..... 269/904

4,181,295 1/1980 Duffy ..... 269/904

*Primary Examiner*—James L. Jones, Jr.

*Attorney, Agent, or Firm*—Arnold S. Cohn

[57] ABSTRACT

A wallboard positioning apparatus comprising a self locking wrench such as a Vice grip wrench or spring clamp which has been modified with the addition of two components; namely, a stop and an adjustable or non-adjustable proximity locating means creating a gap, the wallboard positioning apparatus utilized by as few as one man in the positioning of and retaining of wallboard during the installation thereof.

1 Claim, 9 Drawing Figures fig. 6
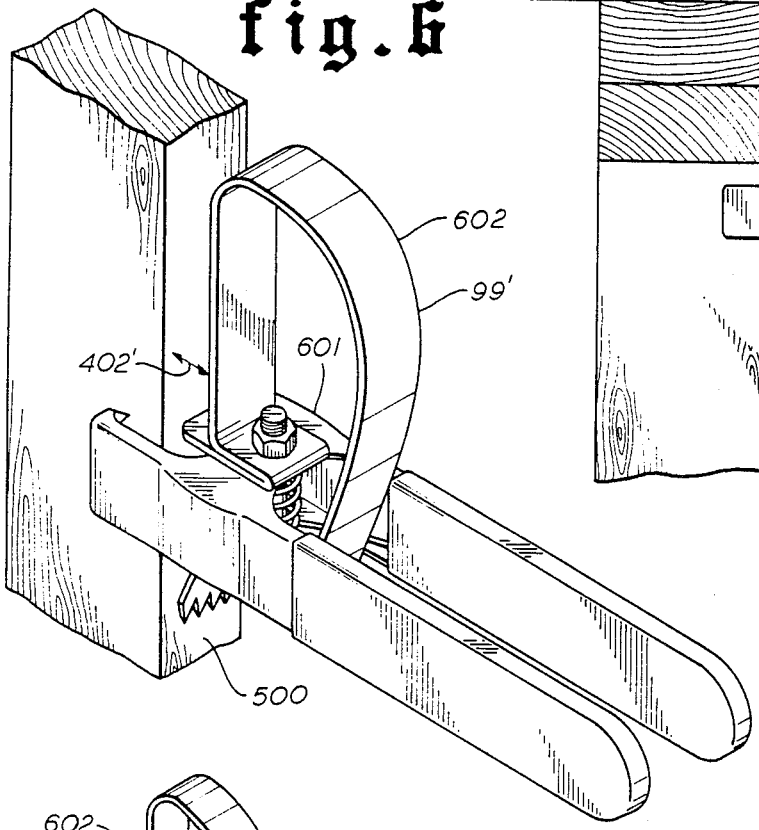
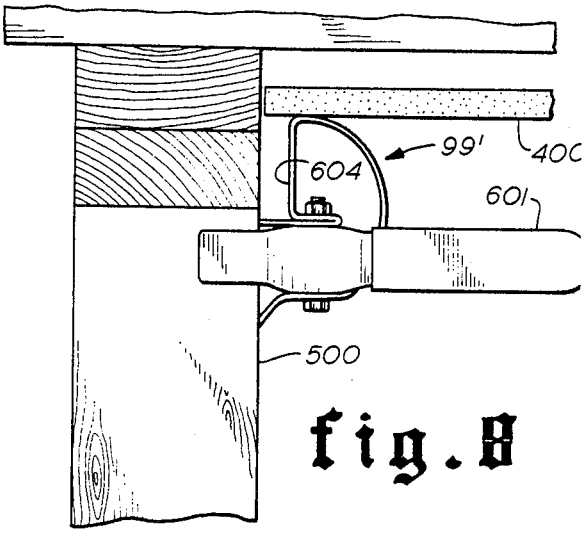
fig. 8
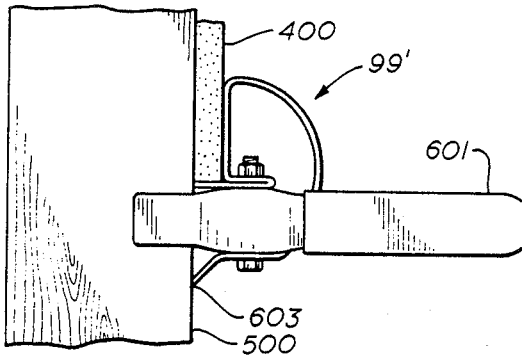
fig. 9
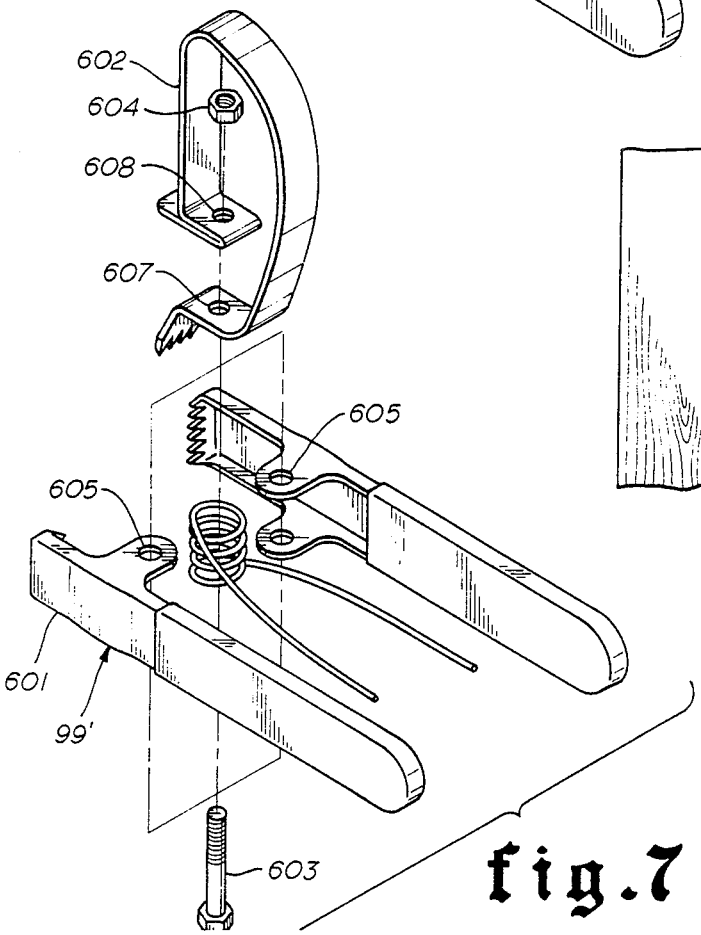
fig. 7

WALLBOARD POSITIONING APPARATUS

CROSS-REFERENCES TO RELATED APPLICATIONS

There are no cross-references in this Application for Letters Patent.

FEDERALLY SPONSORED RIGHTS

There are no rights to any inventions made under or in conjunction with any Federally Sponsored Research and Development Programs.

BACKGROUND OF THE INVENTION

Field of the Invention

The field of the invention is class 81—tools, specifically special tools in subclass 3R. The positioning apparatus of the invention can be classified into subclass 300, which includes tool jaws being positioned by relatively movable handles.

The object of the invention is to provide a tool to permit the one man installation of wall panels or ceiling panels utilized in residential or commercial structures.

A further object of the invention is to provide a tool which will so position said panels in close proximity to the supporting structural studs or structural rafters.

A further object of the invention is to provide a universal tool which can be adjustable according to the thickness of the wallboard which is installed in the particular application thereto.

DESCRIPTION OF DRAWINGS

FIG. 6 is a perspective view of a wallboard positioning apparatus 99' illustrating a spring clamp 601 which has been modified by the addition of a curved band 602 said spring clamp on use on a structural member 500.

FIG. 7 is a perspective view of the spring clamp illustrating the pivot hole 605 on said spring clamp to which the said curved band is alligned therewith.

FIG. 8 is an elevation view of the wallboard positioning apparatus 99' being used supporting wallboard which is being installed on a ceiling.

FIG. 9 is an elevation view of the wallboard positioning apparatus 99' being used supporting wallboard which is being installed on a vertical wall.

DETAILED DESCRIPTION OF THE DRAWINGS

Figure 1:
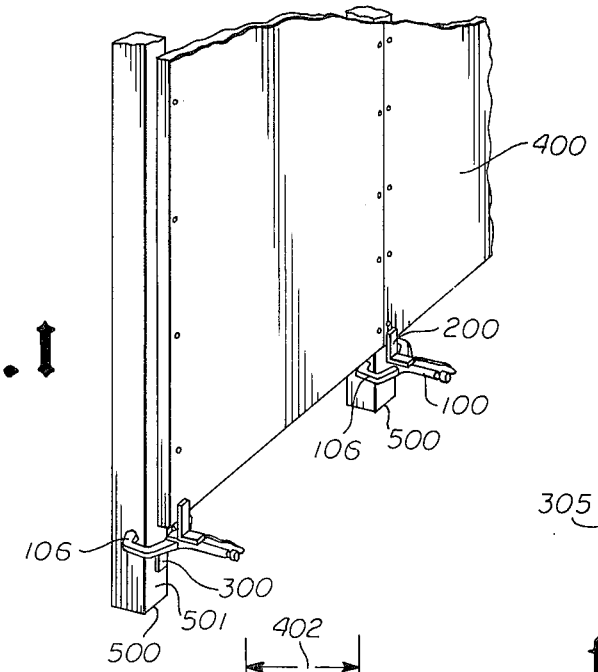
FIG. 1 is a perspective view of the wallboard positioning apparatus 99 illustrating the variable gap 402 which is adjustable for accommodation of variable thickness wall board 400.
Figure 2:
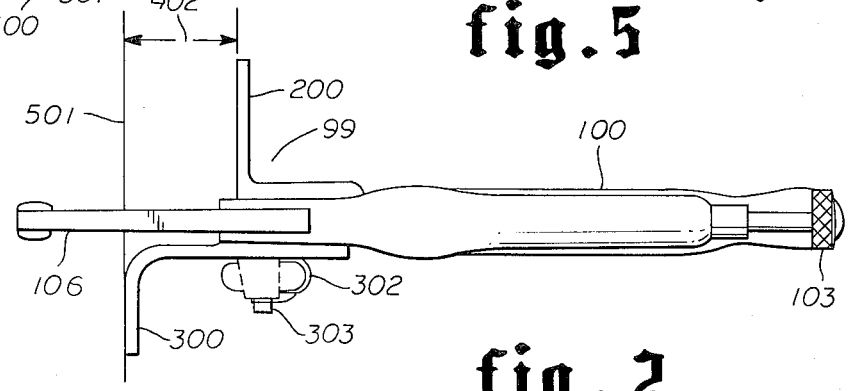
FIG. 2 is an elevation view of the wallboard positioning apparatus 99 illustrating the variable gap 402 which is adjustable for accommodation of variable thickness wall board 400.

In FIG. 2, a wallboard positioning apparatus 99 is disclosed illustrating the subject matter of the invention consisting of a stop 200 and a proximity locating means 300 which are attached to a self locking wrench 100. Although a particular kind of wrench namely a vice-grip wrench is disclosed, any spring loaded device which is attachable and self locking onto a structural member 500, as shown on FIG. 1, or the like is contemplated.

The said stop 200 is permanently attached to top of the said self locking wrench 100. The said proximity locating means 300 is demountably attached to the bottom of the said self locking wrench 100 by means of a post 303 and a tightening means 302. The post 303 is threaded to accept the tightening means 302 and is perpendicularly placed in relation to the bottom of the said self locking wrench 100. Axial movement of the said proximity locating means 300 along the axis of the said self locking wrench 100 is the means for establishing a gap 402. The said gap 402 is variable in order to accommodate wall boards 400 of different thickness as shown in FIG. 1. The said proximity locating means 300 is positionable adjacent to the structural member surface 501 of said structural member 500. In the Vice-grip wrench disclosed, a wrench gripping thickness mechanism adjusting means 103 is utilized in locking a pair of arm 106's in place.

Figure 3:
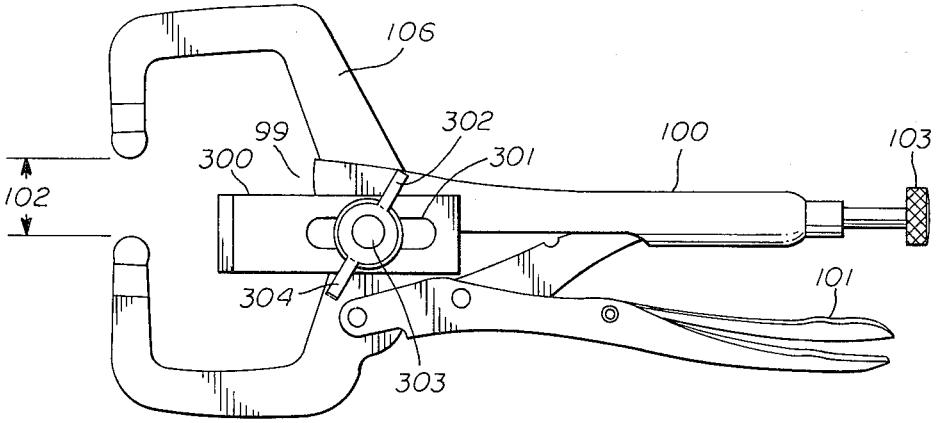
FIG. 3 is a plan view of the wallboard positioning apparatus 99 illustrating the translational adjustability of the proximity locating means 300 and the tightening means 302 thereof.

In FIG. 3, the self locking wrench 100 is illustrated with the pair of arms 106 set apart a distance of wrench gripping thickness 102 which is that distance equivalent to the thickness of a structural member 500 as shown in FIG. 1. The wrench gripping thickness 102 is adjustable utilizing the wrench gripping thickness mechanism adjusting means 103 and release lever 101. The proximity locating means 300 is positioned against the structural member 500 and the proximity of the pair of arms 106 is controlled by the axially adjustability of the proximity locating means 300. The degree of adjustability depends on the length of a slot 301 of the proximity locating means 300. A post 303 is perpendicularly disposed to the main body of the self locking wrench 100. It is of a smaller diameter than the width of the slot 301 and is threaded to accommodate a tightening means 302. Once the proximity locating means 300 is positioned, the tightening means 302 holds the proximity locating means 300 against the self locking wrench 100.

Figure 4:
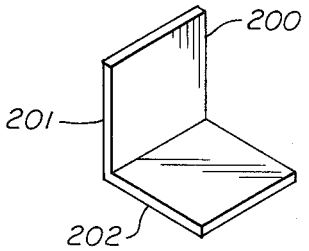
FIG. 4 is a perspective view of the stop 200 to which restrains the potential outward movement of the wall board 400.

In FIG. 4 the stop 200 is illustrated. It is a narrow strip of material having a inner face 201 and bottom surface 202 which are right angulated to each other. The length and width of the stop 200 are of such dimension to permit the stop 200 to be permanently affixed to the top of the body of the self locking wrench 100. This affixation can be by spot welding, riveting, bolting, welding, or integrally casting or forming during the manufacture of the self locking wrench 100.

Figure 5:
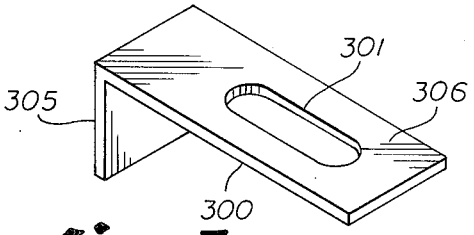
FIG. 5 is a perspective view of the proximity locating means 300 illustrating a surface 305 which locates the self locking wrench 100 against a structural member 500.

In FIG. 5 the proximity locating means 300 is illustrated. It is of the same shape as the stop 200 but additionally has a slot 301 axially and centrally located on a proximity locating means top surface 306. The proximity locating means top surface 306 is perpendicular to a surface 305.

In FIG. 6 a spring clamp which has been modified with the subject invention is shown clamped on a structural member. The proximity member 602 at its lower contact point 603 end is in contact with said structural member. The upper end of the proximity member is offset a distance from the structural member establishing gap 402 between wallboard surface 604 and said contact point 603.

In FIG. 7, holding means 603, shown as a bolt and nut, functions as the pivot member for the spring clamp and the fastening device for curved band.

In the installation of the various types of wallboard such as plywood sheet, insulation panels, sheetwork panels, plasterboard panels and the like, two men are typically required to accomplish the installation onto vertical walls or ceilings. A laborer typically holds the wallboard supporting its weight during which time the artisan positions the wallboard and tacks it in place.

In utilizing the wallboard positioning apparatus 99 in conjunction with the self locking wrench 100 as illustrated or in conjunction with any type of spring loaded clamping means the laborer can be eliminated or his efforts can be directed in other areas during the installation by the artisan.

In utilizing the invention, a plurality of self locking wrenches 100 are attached to the structural members 500. The gap 402 is adjusted by positioning the proximity locating means 300. This gap is determined by the thickness of the wallboard that is being installed. The artisan will place one end of the wallboard in the gap 402 and then swivel or rotate the wallboard to its approximate preferred location with the wallboard in contact with the structural member surface 501 of each structural member 500 or set of self locking wrenches 100 which are secured at the other end of the wallboard. At this time each self locking wrench 100 can be slightly relocated in order to exactly position the wallboard in its preferred location where it will be tacked or otherwise secured.

SUMMARY OF THE INVENTION

A stop 200 and a proximity locating means 300 in combination with a self locking wrench 100 comprises the subject matter of the invention.

The holding force which pressurizes the wallboard against structural members is transmitted through the stop 200 which is permanently attached to a self locking wrench 100. In the case of ceiling applications the weight of the ceiling board is transmitted to the structural members through the self locking wrench 100 since the weight is supported by the stop 200.

The proximity locating means 300 is positionable on the opposite side of the self locking wrench 100 whereat the stop 200 is positioned. When the wallboard positioning apparatus 99 is utilized the inner face 201 of stop 200 and the surface 305 of proximity locating means 300 paralled but offset creating the gap 402. The gap 402 is equal to or slightly larger than the thickness of the wallboard which is being installed. To adjust the gap, the proximity locating means 300 has a slot 301 and a tightening means 302 in combination with a post 303 which is integral with said self locking wrench 100.

The wallboard positioning apparatus 99 as delineate in FIGS. 1–4 has gap adjustment means utilizing the slotted proximity locating means 300 whereas in FIGS. 6–9 a spring clamp 601 with a preset and non-adjustable gap 402' is delineated.

DESCRIPTION OF THE PREFERRED EMBODIMENTS

It is preferred that the invention be utilized in conjunction with a self locking wrench 100 such as commercially available vice-grip type wrenches. A stop 200 is permanently affixed to the main body of a Vice-grip wrench in such a manner to permit a inner face 201 of stop 200 to parallel the wall board 400 which it is supporting at which time the self locking feature of said vice grips wrench is in use.

The distance between the wall board 400 and inner face 201 of stop 200 is set prior to the use of the wallboard positioning apparatus 99 to a value slightly exceeding the thickness of the wall board 400. This is accomplished by positioning the adjustable proximity locating means 300 by rotating and aligning the surface 305 parallel in reference to the inner face 201 of stop 200 and the face of wall board 400.

Another embodiment of the invention is the use with spring clamps. A non-adjustable gap apparatus is delineated in FIG. 6.

It is intended and desired that the embodiments shown and described in detail herein shall be deemed illustrative in nature and not restrictive in order that various modifications thereof will be apparent to those skilled in the art and be applied thereto without departing from the scope of the present invention.

Having just described the invention what we claim being new is:

1. An apparatus for holding wallboard in place during the installation operation being performed by as few as one workman, comprising:

(a) a self locking wrench means having a range of use in conjunction with structural members which may vary in thickness between sheet metal gage thickness and typical wooden structural members such as studs and rafters thickness, (b) a stop having an interface parallel to wallboard which is attached on one side of the said self locking wrench means;

(c) a post which is threaded and perpendicular attached on the said self locking wrench means on the side opposite to that side of said self locking wrench means whereat the said stop is attached;

(d) a proximity locating means having a surface ajustably parallel to said wallboard means surface perpendicular to each other and having an axially located slot on said proximity locating means surface; and (e) tightening means which are locateable on said post used in fastening said proximity locating means on the side opposite of said self locking wrench means to which said stop is located.

* * * * *